United States Patent [19]

Crowley et al.

[11] 4,198,556

[45] Apr. 15, 1980

[54] HAIR DRYER

[75] Inventors: George C. Crowley, Winnetka; Donald N. Jursich, Chicago, both of Ill.

[73] Assignee: Sunbeam Corporation, Chicago, Ill.

[21] Appl. No.: 814,409

[22] Filed: Jul. 11, 1977

[51] Int. Cl.[2] ..... A45D 20/24

[52] U.S. Cl. ..... 219/370; 34/97; 34/243 R; 132/9; 219/367; 219/368; 219/373

[58] Field of Search ..... 219/366–382; 34/96–98, 243 R; 132/9, 11 R, 32; 403/160, 102, 93, 96

[56] References Cited

U.S. PATENT DOCUMENTS

| | | | |
|---|---|---|---|
| 401,003 | 4/1889 | Burns | 403/93 |
| 1,659,780 | 2/1928 | Meyer | 219/366 |
| 2,602,878 | 7/1952 | Holody | 219/374 |
| 2,742,936 | 4/1956 | Cooley | 403/160 |
| 3,086,698 | 3/1961 | Goldstein | 219/370 |
| 3,397,463 | 8/1968 | Laing | 219/370 |
| 3,846,047 | 11/1974 | Wada et al. | 219/370 |
| 3,981,314 | 9/1976 | Barradas | 34/97 |
| 3,986,272 | 10/1976 | Feierabent | 34/243 R |

*Primary Examiner*—B. A. Reynolds
*Assistant Examiner*—Bernard Roskoski
*Attorney, Agent, or Firm*—George R. Clark; Neil M. Rose; Clifford A. Dean

[57] ABSTRACT

A hair-drying appliance having a cylindrical housing and a handle rotatably mounted at one end thereof for movement between a first position generally perpendicular to the housing and a second position in longitudinal alignment with the housing. A single locking lever is provided for latching the handle in either of its positions. The appliance has a first air outlet at one end of the cylindrical housing and a second air outlet in the side wall of the housing adjacent the first air outlet. An adaptor, which is mountable on the housing adjacent the second air outlet only when the handle is in its second aligned position, has a plate portion for blocking the first air outlet and means for supporting comb and brush attachments thereon.

7 Claims, 5 Drawing Figures

HAIR DRYER

BACKGROUND OF THE INVENTION

Portable hand-held hair dryers with heated air outputs have been used extensively both by barbers and in beauty salons as well as by individuals in the home for many years. As the home market has increased in recent years, these appliances have developed primarily in two separate and distinct categories, the blower/dryers and the styler/dryers.

Blower/dryers are used primarily for drying the user's hair and provide a hot concentrated air flow. Such appliances typically have a cylindrical portion from which the hot air exits axially out one end thereof. The air outlet opening is relatively small and thus provides a high velocity concentrated air flow. With the high velocity air flow, the temperatures used in such blower/dryers can be extremely high without creating a risk of internal heat build-up by the heating elements and as such, the drying power of these devices is quite high. The most common blower/dryer configuration is the gun-type unit in which a handle portion extends downwardly at a right angle from the cylindrical body portion of the product. The motor and a centrifugal fan are positioned at the junction of the handle and body portion. Electrical heating elements are provided between the fan and the frontally located air outlet. Attachments such as a brush or comb cannot be used with such blower/dryers and, if brushing or combing is desired for styling, the consumer must use both hands, the blower being held in one and a brush or comb in the other. The gun-type configuration for a blower/dryer, however, is convenient to use and efficient if a second person is drying the actual user's hair, such as a professional hair stylist.

A styler/dryer appliance, on the other hand, is characterized by having various styling attachments, such as a brush or a comb, and typically has an elongated body with a head portion in which the hot air flow exits laterally therefrom. Thus, the appliance can be manipulated in the same fashion as is a common brush with one's hair being dried and styled as the user merely brushes or combs his or her hair. A typical construction of a styler/dryer incorporates a tangential fan within the head portion thereof with the heating elements being positioned between the fan and the lateral air outlet. Such a construction, additionally containing a water spray feature, is disclosed in the Churas et al U.S. Pat. No. 3,905,379. The air outlet contained in styler/dryers is of a larger area than that of the typical blower/dryer and consequently the air exits through this outlet at a lower velocity. This lower velocity and less concentrated air flow will not tend to adversely blow or scatter the user's hair as much as the high velocity air in the blower/dryer, thereby facilitating the styling operation.

The preferred and most efficient manner of preparing one's own hair would be to use a blower with its high temperature and concentrated air flow during the initial drying process and, after the hair has been partially dried, to use a styler/dryer to complete the drying and to properly style the user's hair. In view of these considerations, it would be advantageous to have a single portable hand-held product that would provide the functions and advantages of both a blower/dryer appliance as well as a styler/dryer appliance.

SUMMARY OF THE INVENTION

The present invention provides an improved hair drying appliance which can be used either as a gun-type blower/dryer or, in the alternative, as an elongated styler/dryer with attachments that can be placed on the side thereof. The invention includes a housing having an elongated cylindrical body portion and an elongated handle portion, each portion being attached to the other at one end. Within the main cylindrical body portion, there is provided an air inlet close to the handle end, a small air outlet at the opposite end and a larger air outlet on the side of this body portion. The body portion and the handle portion are rotatable with respect to each other so that one can have a gun-type or pistol configuration with these two portions at right angles to each other or, in the alternative, the handle portion can be rotated to a position in line with the main cylindrical body portion.

When the hair drying appliance of the present invention is used in its gun-type configuration, the hot air flow will exit through the air outlet at the front end and the product will be usable as a typical blower/dryer. In the alternative, the handle portion can be rotated to form an in-line configuration with the main body portion. When the appliance is in this latter configuration, attachments may be mounted on the unit. Each attachment comprises either a brush, comb, or similar hair grooming device, and also has a raised plate portion to block the front end air outlet. In this manner, with this front end blocked, the air flow through the body of the dryer will be directed out of the side-located air outlet and through the particular attachment being used. As such, the present invention can be used as a typical styler/dryer.

The present invention is characterized by various safety mechanisms including a locking member to secure the main body portion and the handle portion in their respective relative positions or configurations when the appliance is being used either as a blower/dryer or as a styler/dryer. This particular locking member additionally functions to prevent the consumer from using or attaching the grooming attachments when the appliance is in its gun-type blower/dryer configuration. Thus, the present invention is further characterized by a low manufacturing cost as well as an easy and uncomplicated operation by the consumer in that both the locking member and the means for preventing use of attachments in the blower configuration are incorporated in the same physical component and both are simultaneously operable in one step by the consumer.

An additional safety feature incorporated in the present invention is a stop member incorporated with the electrical control switch of the appliance. This stop member prevents the highest wattage use of the dryer when it is in its in-line or styler configuration. This is desirable because with the styler configuration the air flow exiting laterally from the main body is not as great as with the unit in the blower/dryer configuration. By preventing use of the highest wattage in the styler configuration, there will be no damaging temperature rise within the unit. When the appliance is used in the gun-type or blower/dryer configuration, however, the aforementioned switch blockage is not created so that all levels of wattage may be employed.

It is an object of the present invention to provide an improved hair dryer which can be mechanically changed to assume two different configurations, one for use as a blower/dryer and the second for use as a styler/dryer, wherein a locking mechanism is provided to secure the hair dryer in either configuration.

It is another object of the present invention to provide a hair drying appliance which can be used either as a hair blower or, in the alternative, as a hair styler wherein attachments used for the hair styler configuration are precluded from use in the blower configuration.

It is still a further object of the present invention to provide a hair drying appliance wherein the locking mechanism securing the hair dryer in either its blower or styler configurations is part of the same component forming the means to prevent use of attachments in the blower configuration.

Further objects and advantages of the present invention will become apparent as the following description proceeds and features of novelty which characterize the invention will be pointed out with particularly in the claims annexed to and forming a part of this specification.

DESCRIPTION OF THE PREFERRED EMBODIMENT

Figures 1, 2:
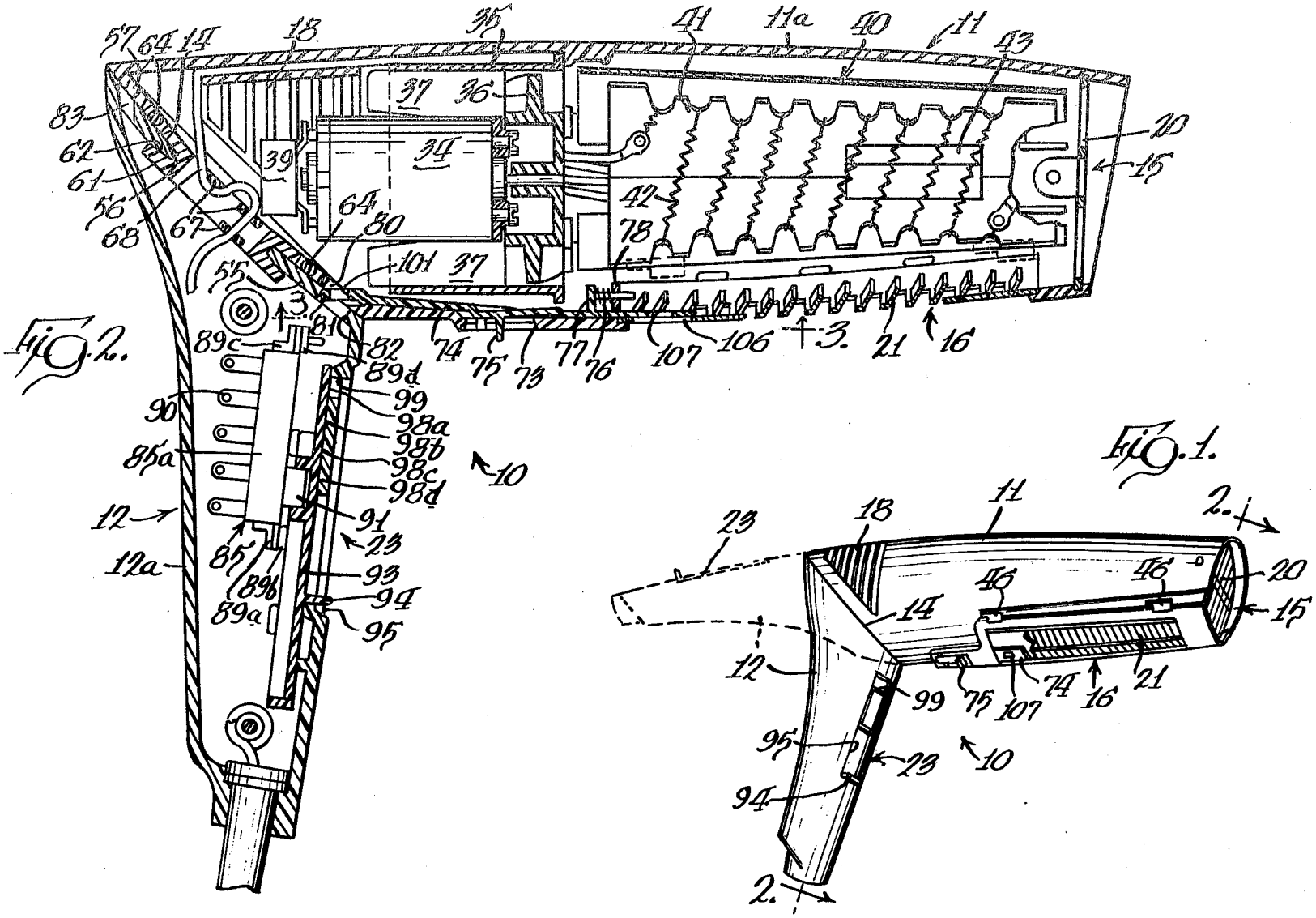
FIG. 1 is a perspective view of the hair drying appliance embodying the present invention with one configuration being shown in full line and with the alternative configuration being shown in dashed lines.
FIG. 2 is a vertical sectional view taken generally on line 2—2 of FIG. 1.

Referring now to the drawings there is shown in FIG. 1 a hair dryer appliance designated generally by reference numeral 10. The hair dryer is shown in its blower/dryer or gun-type configuration with a handle portion 12, having a split plastic housing **12*a*, being positioned at a right angle with respect to a cylindrical body portion 11 having a split plastic housing 11*a*. Also shown in FIG. 1 in dashed lines is the styler/dryer configuration of the appliance 10 wherein handle 12 is aligned with the cylindrical body portion 11. As will be described more fully below, the junction plane or swivel connection 14 between the handle and cylindrical body portions of the hair dryer appliance 10 is inclined at an angle of approximately 45° to the central axis of the body portion 11 so that the two different hair dryer configurations can be obtained by a mere rotation of the handle 12** about its own axis.

Toward the front end of the cylindrical body housing **11*a* there are located two hot air outlets 15 and 16, air outlet 15 being used with the hair dryer in its gun-type configuration and air outlet 16 being used in its styler configuration. An air inlet 18 is provided toward the back end of the body housing 11*a*. Metal protective grills 20 and 21 are provided covering the air outlets 15 and 16, respectively, in order to prevent hair, fingers, or any other objects from protruding into the cylindrical body portion 11** and toward the electrical heating elements contained therein.

In order to turn on the hair drying appliance 10 and to set it at its various heat levels and fan speeds, there is provided a control switch assembly 23. As shown in FIG. 1, the switch assembly 23 is positioned in the handle 12 so that the switch assembly will be positioned toward the front and inside of the hair dryer appliance while in the gun-type configuration. When the handle is rotated into the styler configuration the switch assembly 23 will be located at the top of the unit.

In order to secure the handle portion 12 against accidental displacement with respect to the body portion 11, there is provided a locking button 75 which will secure the handle 12 in proper position with respect to the cylindrical body portion 11 for the two alternative modes or configurations of the hair dryer. The structure and operation of the locking button 75 will be described hereinafter.

Inside the housing **11*a* there is contained a small D.C. motor 34 for driving a set of fan rotor blades 36 of an axial fan assembly 35. Surrounding the motor 34 and channeling the air flow from the air inlet 18 toward the fan rotor blades 36 are a set of fan stator blades 37. A standard diode bridge package 39 is attached to the back of the motor 34** and is used to convert the AC electrical supply to DC.

Within the housing **11*a* and forward of the fan assembly 35, there is secured a heating assembly 40, including several intersecting mica boards 41 which support hair dryer heating elements 42. Centrally disposed within the heating assembly 40 is a thermostat 43** which prevents the temperature of the hair dryer appliance from exceeding a desired temperature level.

The cylindrical body portion 11 is constructed such that upon energization of the motor 35, the fan rotor blades 36 will rotate drawing air in through air inlet 18, through the stator blades 37, past the heating elements 42 and out through one of the air outlets. Without any obstructions, the air current pattern will carry the air flow axially along the cylindrical body portion 11 of the hair dryer 10 and out the air outlet 15. The vanes of grill 21 of the air outlet 16 are also slightly angled upwardly and forwardly, as shown in FIG. 2, to discourage and further deter air from exiting through the air outlet 16 when the hair dryer 10 is used in the gun-type configuration.

Figure 5:
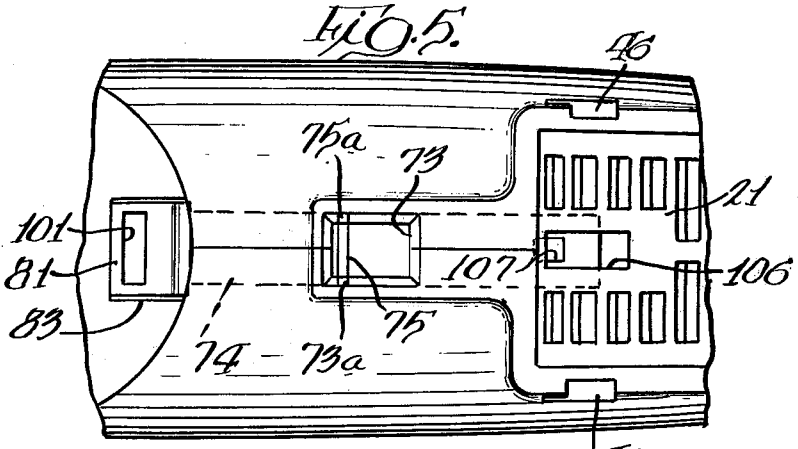
FIG. 5 is a fragmentary bottom plan view similar to FIG. 3 taken generally on line 6—6 of FIG. 4 with the hair dryer in its styler configuration.

As shown in FIG. 5, an attachment adaptor 45 is provided which is adapted to be secured to the cylindrical body portion housing **11*a* only when the handle 12 is rotated to its in-line position of its hair styler/dryer configuration. The adaptor 45 is secured to the housing 11*a* by four pegs or pins 48 which fit into four bayonet-type slots 46, two each of which slots 46 are located on each side of the air outlet 16 provided in the hair dryer housing 11*a*. The front portion of the adaptor 45 is also characterized by an upturned plate member 47 which extends across the front end of the housing 11*a* and serves to block the air outlet 15 provided therein. Thus, when the adaptor 45 is in position, the air flow will be directed or forced out through air outlet 16. For reasons that will be described hereinafter, only after the adaptor 45 has been detached from the body portion 11 can the handle portion 12 be rotated to its position generally perpendicular to the cylindrical body portion 11 whereby the hair dryer appliance 10 can be used as a typical gun-type blower/dryer with hot air exiting through the air outlet 15. By rotating the handle 12 to its position in line with the cylindrical body portion 11 and by securing the adaptor 45 thereto, the hair dryer appliance 10 can be used as a conventional styler/dryer with hot air being directed out through the air outlet 16, the air outlet 15 being blocked by the adaptor plate 47. Various attachments, such as a brush 50 shown in FIG. 5 can be secured to the adaptor 45** for use in styling the consumer's hair as disclosed in somewhat greater detail in a patent application in the name of John L. Benty, Ser. No. 814,658 entitled Hair Dryer, assigned to the same assignee as the present invention and filed concurrently herewith.

As previously noted, the hair dryer appliance 10 of the present invention includes the handle portion 12 which can be rotated through a swivel connection with respect to the cylindrical body portion 11 in order to alternate the hair dryer between a gun-type blower/dryer configuration and an in-line styler/dryer configuration. In order to accomplish this rotation, the handle housing 12*a* is provided at its end adjacent the junction plane 14 with an end wall 55 having a centrally disposed circular hole defining an annular edge 56. As best shown in FIG. 2 and FIG. 5, the cylindrical body housing 11*a* adjacent the junction plane 14 is provided with a centrally bored end wall 57 having a pulley type formation projecting outwardly therefrom. The pulley type formation is characterized by an enlarged head 61 with an annular slot 62 being defined between the head 61 and the end wall 57. The annular edge 56 of the hole 60 in the end wall 55 of the handle housing 12*a* rotatably fits within the annular slot 62 formed at the end of the cylindrical body housing 11*a* to provide the swivel connection therebetween. In order to insure proper tension between the handle and the cylindrical body housings, there are also provided resilient tabs 64 formed in the end wall 57 of the body portion housing 11*a*. The tabs 64 contain raised end members which abut the end wall 55 of the handle housing 12*a* thereby maintaining the desired pressure between the handle and cylindrical body housings. Thus, with the junction plane 14 being at approximately 45° with respect to the cylindrical body and handle axes, rotation of the handle 180° about its own axis will change the hair dryer 10 from the gun-type configuration to the in-line configuration or the reverse thereof. The end wall 57 of the cylindrical body portion housing 11*a* is also provided with a series of projections or fingers 67 which extend into the central bore formed therein and through which an electrical cord 68 can be woven and secured, as is best shown in FIG. 2.

In order to lock the relative positions of the handle portion 12 with respect to the cylindrical body portion 11 in the two alternative configurations of the hair dryer appliance, there is provided a locking lever 74 best shown in FIG. 2 and FIG. 5 at the bottom of the cylindrical body portion 11. The locking lever 74 carries the operating button 75 which extends outwardly through an opening 73 in housing 11*a*. The locking lever 74 is spring biased rearwardly by a coil spring 76 which is seated between a locking lever extension 77 and a stop member 78 formed in the housing 11*a*.

Figure 3:
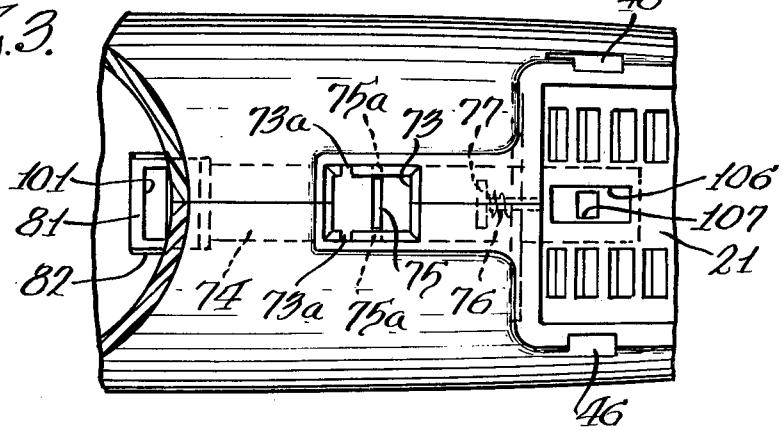
FIG. 3 is a fragmentary bottom plan view, partially in horizontal section, taken generally on line 3—3 of FIG. 2 with the hair dryer in its blower configuration.

The actual locking operation is accomplished by a rear end 81 of the locking lever 74 extending through a passageway 80 formed in housing 11*a* and into either a slot 82 or a slot 83, both of which are formed in the handle housing 12*a* in diametrically opposite positions, slot 82 being aligned with passageway 80 when the hair dryer appliance is in its gun-type blower/dryer configuration and slot 83 being aligned with passageway 80 when the handle 12 has been rotated to the in-line styler/dryer configuration. Thus, as best shown in FIG. 2 and FIG. 3, with the blower/styler configuration, rear end 81 of the locking lever 74 is spring biased within slot 82 and prevents any rotation of the handle 11 with respect to the body portion 12. In the styler/dryer configuration, the locking mechanism, as shown in FIG. 5 and FIG. 6, has rear end 81 of the locking lever 74 biased into engagement within slot 83. In order to alternate the hair dryer appliance from the blower/dryer configuration to the styler/dryer configuration, for example, the user pushes the locking lever forward by pushing the operating button 75 toward the right, as shown in FIG. 2, thereby disengaging end 81 from the elongated slot 82, and rotates the handle portion 12. As the handle portion is rotated into its in-line position with the cylindrical body portion 11, the elongated slot 83 will become aligned with the passageway 80 thereby allowing the spring biased locking lever 74 to be inserted therein, thus locking the appliance in its styler/dryer configuration.

The operating button 75 is formed in a somewhat T-shaped configuration with projections 75*a* extending laterally on either side thereof. As best shown in FIGS. 3 and 5, these projections are adapted to be received within transverse slots 73*a* formed in the longitudinal edges of the opening 73 when the hair dryer is in its in-line styler/dryer configuration. As such, in order to change the hair dryer from its in-line position, the operating button 75 must first be pushed inwardly with respect to the hair dryer, thereby disengaging projections 75*a* from slots 73*a*. Button 75 can then be pushed to the right, as shown in FIG. 5 and FIG. 6, in order to disengage end 81 of the locking lever 74 from slot 83 in the handle housing 12*a*.

The hair dryer appliance of the present invention may be operated at three different heating levels and two different fan speeds, the faster fan speed used with the high and medium heating levels. In order to operate the hair dryer, there is provided a four position slide switch 85, as part of the switch assembly 23. the mechanical structure of this assembly is best shown in FIG. 2. A switch housing 85*a* is secured within the handle housing 12*a* in a known manner by housing projections and supporting members 89*a*, 89*b*, 89*c* and 89*d*. Electrical connector tabs or contacts 90 are located on the back side of the switch housing 85*a*. On the opposite side of switch housing 85*a* there is located a slide button 91 for varying the several electrical positions of the switch 85. Overlying the slide button 91 there is provided an elongated switching lever 93 with a raised button portion 94. The button portion 94 extends through an opening 95 provided in the housing 12*a*. As the button portion 94 is moved back and forth by the consumer, the slide button 91 of switch 85 will correspondingly be moved to its various positions. Indicia marking the "off", "low", "medium", and "high" positions of the switch 85 may be imprinted on the outer face of the switching lever 93 at locations 98*a*, 98*b*, 98*c* and 98*d*, respectively. The particular indicia corresponding to the location of the switching lever 93 and the similarly corresponding electrical position of slide switch button 91 is readily visible through an opening 99 provided in the housing 12*a*.

When the hair dryer appliance 10 is in its gun-type blower/dryer configuration, as shown in FIG. 2, and the switching lever 93 is moved into its position for the high wattage setting, the end of switching lever 93 adjacent indicia 98*a* protrudes through both the elongated slot 82 in handle casing 12*a* and opening 101 provided in the rear end 81 of locking lever 74, locking lever 74 also having its rear end 81 disposed in slot 82 in handle casing 12*a*, as previously described herein. Opening 101 is clearly shown in FIG. 3 and FIG. 5. With this structural arrangement, with the hair drying appliance 10 in its gun-type blower/dryer configuration and the switching lever 93 in its high wattage position, the locking member 74 may not be disengaged from its locking engagement with the handle casing 12*a* and the handle 12 may therefore not be rotated into its in-line styler/dryer configuration, thus insuring against high wattage use of the appliance when in its styler/dryer configuration, as will be discussed further herein.

With the hair dryer in its in-line styler/dryer configuration, it is not desirable to allow operation of the appliance 10 in its highest wattage mode in that with the air outlet 15 being blocked and only air outlet 16 being open there will be insufficient continuous air flow to prevent an undesirable heat build-up. Therefore, in order to prevent use of the appliance 10 in its high wattage mode when in its styler/dryer configuration, the movement of switching lever 93 is blocked before its high wattage position can be reached. This electrical switch and the limiting feature thereof in the styler/dryer configuration is more fully described in a patent application entitled Control Switch for Hair Dryer, filed by Mr. George Crowley concurrently herewith, and assigned to the same assignee as the present invention.

Figure 4:
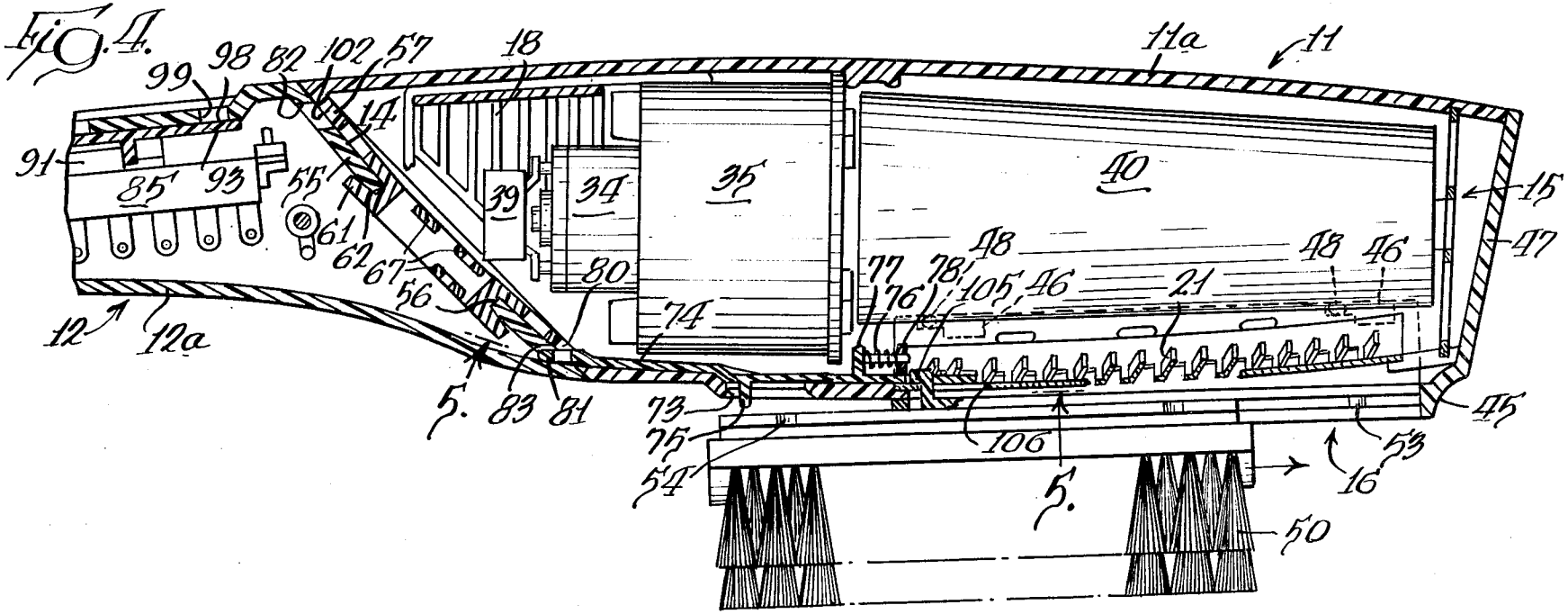
FIG. 4 is a vertical section view similar to FIG. 2 with the hair drying appliance in its alternative configuration and also showing an attachment mounted thereon.

As a further safety feature of the present invention, means are provided whereby the adaptor 45 and its front plate member 47 for blocking air outlet 15 cannot be attached to the casing 11*a* when the hair dryer 10 is in its gun-type blower/dryer configuration. The adaptor 45 is provided with an upwardly projecting inverted L-shaped latch member 105, as shown in FIG. 5, which latch member is adapted to extend through an opening 106 provided in the grill 21 and to be latchingly engaged in a hole 107 provided in the forward end of the locking lever 74. Thus, in order for the adaptor 45 to be attached to the hair dryer 10 with pegs 48 properly secured within the slots 46 it is necessary that hole 107 be movable into a properly aligned position to receive and latchingly engage the L-shaped latch member 105. In the gun-type configuration of the appliance 10 as best shown in FIG. 3, the locking lever 74, in its normal rearwardly biased position, will be slightly forward of its corresponding position in the in-line configuration shown in FIG. 5, as will now be described. As shown in FIG. 4, slot 83 is formed such that when the hair dryer appliance is in its styler/dryer configuration, there will be ample clearance in slot 83 to allow sufficient rearward movement of the locking lever 74 to permit proper latching engagement of the latch member 105 of the adaptor 45 in the hole 107 formed in the forward end of the locking lever 74. Furthermore, in this position projections 75*a* of button 75 will be secured within slots 73*a* as previously described. However, in the gun-type configuration, FIG. 2, the design of notch 82 is such that the rear end 81 of the locking lever 74 engages an edge thereof and thus can not move rearwardly far enough to provide proper latching engagement of either the pegs 48 in the slots 46 or the latching member 105 in the hole 107 in the locking lever 74. It is therefore seen that the structural arrangement of the appliance 10 is such that the adaptor 45 may only be properly attached to the housing 11*a* when the appliance is in its in-line styler/dryer configuration.

While there has been shown and described a single embodiment of the present invention, it will be apparent to those skilled in the art that numerous changes and modifications may be made without departing from the invention in its broader aspects and it is, therefore, contemplated in the appended claims to cover all such changes and modifications which fall within the true spirit and scope of the present invention.

What is claimed as new and desired to be secured by Letters Patent of the United States is:

1. In a combination hair drying appliance of the type having a housing, a motor actuated fan mounted in said housing, air inlet and air outlet means disposed at opposite ends of said housing, and heater means mounted in said housing between said fan and said air outlet means, said housing being generally cylindrical in configuration and having an elongated handle rotatably connected to the air inlet end thereof with the junction plane between said cylindrical housing and said handle being disposed at an angle of approxinately 45° with respect to the axis of said cylindrical housing, said handle being rotatable with respect to said cylindrical housing between a first position in which said handle is generally perpendicular to said cylindrical housing and a second position in which said handle is in longitudinal coaxial alignment with said cylindrical housing, the improvement which comprises a single slideably mounted, elongated locking lever for slideably latching said handle in either said first or said second positions, said slideable locking lever being biased into its locking positions by a spring and said handle being provided with spaced apart slots each of which is adapted to be latchingly engaged by the rear end of said locking lever in said first and second positions of said handle, said air outlet means being characterized by a first opening at the forward end of said cylindrical housing through which heated air is discharged when said handle is in its first generally perpendicular position and by a second opening formed in the side wall of said cylindrical housing adjacent the forward end of same through which heated air is discharged when said handle is in its second longitudinally aligned position, and means permitting mounting of an adaptor on said cylindrical housing overlying said second opening only when said handle is in its second aligned position, said adaptor being provided with an upstanding plate portion adapted to block said first opening and with means for removably supporting comb and brush attachments thereon.

2. A combination hair drying appliance improvement as claimed in claim 1 wherein said adaptor is provided with a plurality of pegs engageable in a plurality of bayonet-slots formed on said cylindrical housing and with a finger-like latch member engageable in an opening provided in said locking lever.

3. A combination hair drying appliance improvement claimed in claim 2 wherein said pair of locking lever receiving slots in said handle have configurations such that said locking lever is biased into different longitudinal positions relative to said cylindrical housing in said first and second positions of said handle, whereby in said first position of said handle said locking lever is so positioned relative to said housing that said adaptor latch member is not latchingly engageable in said locking lever opening and said adaptor pegs are therefore not properly seated in said bayonet-slots to secure said adaptor on said housing but whereby in said second position of said handle said locking lever is so positioned relative to said housing that said adaptor latch member is latchingly engageable in said locking lever opening and said adaptor pegs are properly seated in said bayonet-slots with said adaptor therefore being securely mountable on said housing only when said handle is in said second longitudinally aligned position.

4. A combination hair drying appliance improvement as claimed in claim 3 wherein said adaptor latching opening in said locking lever is provided in the forward end of said locking lever and wherein the configurations of said handle slots in which said rear end of said locking lever is latchingly engaged are such that when said handle is in its second aligned position said locking lever is biased further rearwardly relative to said cylindrical housing than when said handle is in said first generally perpendicular position.

5. In a combination hair drying appliance of the type having a cylindrical housing, a handle mounted on the rear end thereof for rotation between a first pistol-grip position and a second position in longitudinal alignment with said housing, an air inlet and two air outlets with one outlet being disposed at the forward end of said cylindrical housing and the other outlet being disposed in the bottom wall of said housing adjacent the forward end thereof, a motor driven fan in said housing, heater means in said housing between said fan and said air outlets, and means for directing heated air through said one outlet when said handle is in said pistol-grip position and through said other outlet when said handle is in said aligned position, the improvement which comprises a locking lever on said housing for latching said handle in each of its two positions, an adaptor mountable on said cylindrical housing adjacent said other air outlet and having means thereon for removably supporting comb and brush attachments, and means permitting mounting of said adaptor on said housing only when said handle is in said aligned position.

6. A combination hair drying appliance improvement as claimed in claim 5 wherein means are provided on said handle for varying the latching movement of said locking lever relative to said housing when latching said handle in its two positions, and means on said locking lever adaptable for latching engagement with said adaptor only when said handle is in said aligned position.

7. A combination hair drying appliance improvement as claimed in claim 6 wherein said heated air directing means comprises an upstanding plate provided on said adaptor for blocking said one air outlet, and a grill mounted over said other air outlet and having a plurality of lateral vanes angled upwardly and forwardly.

* * * * *